US007667675B2

(12) United States Patent
Kyeong et al.

(10) Patent No.: US 7,667,675 B2
(45) Date of Patent: Feb. 23, 2010

(54) METHOD AND APPARATUS FOR DRIVING LIQUID CRYSTAL DISPLAY DEVICE

(75) Inventors: Chang Su Kyeong, Daegu (KR); Seung Kuk Ahn, Kyoungsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 585 days.

(21) Appl. No.: 10/717,675

(22) Filed: Nov. 21, 2003

(65) Prior Publication Data

US 2008/0170027 A1 Jul. 17, 2008

(30) Foreign Application Priority Data

Dec. 16, 2002 (KR) ..... 10-2002-0080228

(51) Int. Cl.
*G09G 3/36* (2006.01)

(52) U.S. Cl. ..... 345/87; 345/98; 345/100; 345/204

(58) Field of Classification Search ..... 345/87, 345/98, 100, 204
See application file for complete search history.

(56) References Cited

U.S. PATENT DOCUMENTS 6,097,362 A * 8/2000 Kim ..... 345/87
6,335,721 B1 * 1/2002 Jeong ..... 345/100
7,095,393 B2 * 8/2006 Lee ..... 345/89

* cited by examiner

*Primary Examiner*—Richard Hjerpe
*Assistant Examiner*—Leonid Shapiro
(74) *Attorney, Agent, or Firm*—McKenna Long & Aldridge LLP

(57) ABSTRACT

A driving apparatus of a liquid crystal display device includes a multiplexer array for performing time-division on inputted pixel data to supply time-divided pixel data, a digital-to-analog converter array for converting the time-divided pixel data into pixel voltage signals, and a demultiplexer array for driving data lines in a time-division manner to supply the converted pixel voltage signals, wherein the digital-to-analog converter array receives a plurality of pixel voltage signal levels inputted from an external source and generates the pixel voltage signals using the pixel voltage signal level with a voltage at least one-step higher in absolute value than the original pixel voltage signal level in correspondence to at least one pixel data.

17 Claims, 12 Drawing Sheets

METHOD AND APPARATUS FOR DRIVING LIQUID CRYSTAL DISPLAY DEVICE

The present invention claims the benefit of Korean Patent Application No. P2002-80228 filed in Korea on Dec. 16, 2002, which is hereby incorporated by reference.

BACKGROUND OF THE INVENTION

1. Field of the Invention

The present invention relates to a liquid crystal display device, and more particularly, to a method and apparatus for driving a liquid crystal display device.

2. Description of the Related Art

In general, liquid crystal display (LCD) devices display images by controlling light transmittance of a liquid crystal material using application of an electric field. The LCD devices comprise a liquid crystal display panel, wherein liquid crystal cells are arranged in an active matrix configuration, and a drive circuit for driving the liquid crystal display panel.

FIG. 1 is a schematic plan view of a liquid crystal display device according to the related art. In FIG. 1, a liquid crystal display device comprises data drive integrated circuits (ICs) 4 connected to a liquid crystal display panel 2 through data tape carrier packages (TCPs) 6, and gate drive ICs 8 connected to the liquid crystal display panel 2 through gate TCPs 10. Although not shown, the liquid crystal display panel 2 comprises thin film transistors formed at each intersection area of gate and data lines, and a liquid crystal cell connected to the thin film transistor, wherein a gate electrode of the thin film transistor is connected to one of the gate lines and a source electrode of the thin film transistor is connected to any one of the data lines. Accordingly, the thin film transistor supplies a pixel voltage signal transmitted along the data line to the liquid crystal cell in response to a scan signal transmitted along the gate line. In addition, the liquid crystal cell comprises a pixel electrode connected to a drain electrode of the thin film transistor and a common electrode that faces the pixel electrode with a liquid crystal material disposed therebetween. Thus, the liquid crystal cell adjusts the light transmittance by driving the liquid crystal material in response to the pixel voltage signal supplied to the pixel electrode.

In FIG. 1, each of the gate drive ICs 8 is mounted on one of gate TCPs 10, and is electrically connected to a gate pad of the liquid crystal display panel 2 through the gate TCPs 10. Accordingly, the gate drive ICs 8 sequentially drive the gate lines of the liquid crystal display panel 2 for each horizontal period (1H). Similarly, each of the data drive ICs 4 is mounted on one of the data TCPs 6, and is electrically connected to a data pad of the liquid crystal display panel 2 through the data TCPs 6. Accordingly, the data drive ICs 4 convert digital pixel data into analog pixel voltage signals and supply it to the data lines of the liquid crystal display panel 2 for each horizontal period (1H).

FIG. 2 is a schematic block diagram of a data drive IC of FIG. 1 according to the related art. In FIG. 2, each of the data drive ICs 4 comprises a shift register array 12 that sequentially supplies sampling signals, first and second latch arrays 16 and 18 that provide and latch pixel data in response to the sampling signals, a first multiplexer (MUX) 15 that is arranged between the first and the second latch arrays 16 and 18, a digital-to-analog converter (DAC) array 20 that converts the pixel data from the second latch array 18 into pixel voltage signals, a buffer array 26 that buffers the pixel voltage signals from the DAC array 20 to provide buffered signals, and a second MUX array 30 that selects a proceeding path of the output of the buffer array 26. In addition, the data drive ICs 4 further comprise a data register 34 for relaying pixel data (R,G,B) supplied from a timing controller (not shown) and a gamma voltage part 36 for supplying positive and negative gamma voltages to the DAC array 20. Each of the data drive ICs 4 has an N-number of channels of data output (i.e., 384 or 480 channels) in order to drive an N-number of the data lines. For example, FIG. 2 shows only 6 channels (DL1 to DL6) of an N-number of channels of the data drive IC 4.

The data register 34 relays the pixel data from the timing controller (not shown) and supplies them to the first latch array 16. The timing controller divides the pixel data into even pixel data (RGBeven) and odd pixel data (RGBodd) for lowering transmittance frequency and supplies them to the data register 34 through each transmittance line. The data register 34 provides the even pixel data (RGBeven) and the odd pixel data (RGBodd) received to the first latch array 16 through corresponding transmittance lines, wherein each of the even pixel data (RGBeven) and the odd pixel data (RGBodd) includes red (R), green (G), and blue (B) pixel data.

The gamma voltage part 36 subdivides a plurality of gamma reference voltages received from a gamma reference voltage generator (not shown) by gray levels to provide subdivided gamma reference voltages.

FIG. 3 is a schematic circuit diagram of a gamma reference voltage generator according to the related art. In FIG. 3, the gamma reference voltage generator generates gamma reference voltages (GMA1 to GMA10) of 10 steps that are to form an entire range of gray levels of 64 steps and supplies them to the gamma voltage part 36. More specifically, the gamma reference voltage generator generates positive gamma reference voltages (GMA1 to GMA5) and negative gamma reference voltages (GMA6 to GMA10) by dividing a supply voltage provided from an external power supply 1 for reference power supply. When dividing the entire gray level by 5 steps, the gamma reference voltages (GMA1 to GMA10) become gamma compensation voltages that correspond to each of the steps.

FIG. 4 is a schematic circuit diagram of a gamma voltage part according to the related art. In FIG. 4, the gamma voltage part 36 (in FIG. 2) divides the gamma reference voltages (GMA1 to GMA10) to generate gamma compensation voltages (VH0, VH1, . . . ) that correspond to the gray levels sub-divided between the gamma reference voltages (GMA1 to GMA 10). The gamma voltage part 36 comprises a plurality of resistors R1 connected in series between the gamma reference voltages of adjacent steps (GMA1 to GMA10) (i.e., between GMA1 and GMA2, between GMA2 and GMA3, . . . , between GMA9 and GMA10). Accordingly, the gamma compensation voltages (VH0, VH1, . . . ) are generated as the gamma reference voltages being subdivided by the registers.

The shift register array 12 generates sequential sampling signals and supplies them to the first latch array 16, which includes an n/6-number of the shift registers 14. For example, the shift register 14 of a first stage (in FIG. 2) shifts a source start pulse (SSP) received from the timing controller according to a source sampling clock signal (SSC) to provide it as the sampling signal, and at the same time provides to the shift register 14 of the next stage as a carry signal (CAR).

FIG. 5A is diagram of an odd frame driving waveform of the data drive IC of FIG. 2 according to the related art, and FIG. 5B is a waveform diagram of an even frame driving waveform of the data drive IC of FIG. 2 according to the related art. In FIGS. 5A and 5B, the source start pulse (SSP)

is supplied for each horizontal period (1H) and is provided as sampling signals shifted for each source sampling clock signal (SSC).

In FIG. 2, the first latch array 16 samples and latches the pixel data (RGBeven, RGBodd) from the data register 34 by a prescribed number of units in response to the sampling signal from the shift register array 12. The first latch array 16 comprises the N-number of the first latches 13 in order to latch the N-number of the pixel data (R,G,B), and each of the first latches 13 has a size corresponding to the number of bits (i.e., 3 bit or 6 bit) of the pixel data (R,G,B). Accordingly, the first latch array 16 samples and latches the even pixel data (RGBeven) and the odd pixel data (RGBodd) for each sampling signal (i.e., six numbers of the pixel data), and then provides all of them at the same time.

The first MUX array 15 determines the proceeding path of the pixel data (R,G,B) provided from the first latch array 16 in response to a polarity control signal (POL) from the timing controller. Thus, the first MUX array 15 comprises an "N−1"-number of first MUXs 17, wherein each of the first MUXs 17 receives outputs of two adjacent first latches 13 and outputs the pixel data (R,G,B) in accordance with the polarity control signal (POL). In addition, the output of each of the remaining first latches 13, except for the first and the last latches 13, commonly receive the pixel data (R,G,B) from two adjacent first MUXs 17. The output of the first and the last latches 13 is commonly received by the second latch array 18 and the first MUX 17, respectively. The first MUX array 15 controls the pixel data (R,G,B) in accordance with the polarity control signal (POL) from each of the first latches 13 to proceed to the second latch part 18, or controls the pixel data (R,G,B) to proceed to the second latch part 18 by shifting to the right by one line.

As shown in FIGS. 2, 5A, and 5B, the polarity of the polarity control signal (POL) is inverted by one horizontal period (1H). As a result, the first MUX array 15 controls the polarity of the pixel data (R,G,B) by a positive DAC (P DAC) 24 or a negative DAC (N DAC) 22 of the DAC array 20 through the second latch array 18, wherein each of the pixel data (R,G,B) from the first latch array 16 responds to the polarity control signal (POL).

The second latch array 18 simultaneously latches and provides the pixel data (R,G,B) received from the first latch array through the first MUX array 15 in response to a source output enable signal (SOE) from the timing controller, and provide the latched pixel data (R,G,B). In addition, the second latch array 18 comprises an "N+1"-number of the second latches 19 when the pixel data (R,G,B) from the first latch array 16 is shifted to the right and received. The source output enable signal (SOE), as shown in FIGS. 5A and 5B, is generated for each horizontal period (1H). The second latch array 18 simultaneously latches the pixel data (R,G,B) provided at a rising edge of the source output enable signal (SOE) and provides the pixel data (R,G,B) at a falling edge.

The DAC array 20 converts the pixel data (R,G,B) from the second latch array 18 into the pixel voltage signal using the positive and the negative gamma compensation voltages (GH (+VH), GL(−VH)) from the gamma voltage part and provides them. For example, the DAC array 20 converts and provides voltages of any one of a plurality of the positive and the negative gamma compensation voltages (GH, GL) into the pixel voltage signal in correspondence to the data provided from the second latch array 18. In addition, the PDAC1 24 provided the first data from the second latch 19, as shown in FIG. 4, provides VH6 voltage to the pixel voltage signal.

For this purpose, the DAC array 20 comprises an "N+1"-number of PDAC 24 and NDAC 22, wherein the PDAC 24 and NDAC 22 are alternatively arranged in parallel for dot inversion driving. The PDAC 24 converts the pixel data (R,G,B) from the second latch array 18 into positive pixel voltage signals using a positive gamma voltage signal, and the NDAC 22 converts the pixel data (R,G,B) from the second latch array 18 into negative pixel voltage signals using a negative gamma voltage signal. Each of the "N+1"-number of buffers 28 included in the buffer array buffers the pixel voltage signals provided from each PDAC 24 and NDAC 22 of the DAC array 20, and provides the buffered pixel voltage signals as its output.

The second MUX array 30 determines the proceeding path of the pixel voltage signals supplied from buffer array 26 in response to the polarity control signal (POL) from the timing controller. For this purpose, the second MUX array 30 comprises the N-number of the second MUXs 32, wherein each of the second MUXs 32 responds to the polarity control signal (POL), selects the output of any one of two adjacent buffers 28, and provides them to the corresponding data line (DL). In addition, the output terminals of the remaining buffers 28, except for the first and the last buffers 28, are each held in common to two adjacent second MUXs 32. The second MUX array 30 having such a configuration responds to the polarity control signal (POL) and makes the pixel voltage signals from each buffer 28, except for the last buffer 28, through its corresponding data line (DL1 to DL6). Furthermore, the second MUX array 30 responds to the polarity control signal (POL) and allows the pixel voltage signals from each of the remaining buffers 29, except for the first buffer 28, to be shifted to the left by one line and to correspond on a one-to-one basis with the data line (DL1 to DL6).

The polarity control signal (POL) is supplied to the first MUX array 15, as shown in FIGS. 5A and 5B, and its polarity is simultaneously inverted for each one horizontal period (1H). Accordingly, the second MUX array 30 together with the first MUX array 15 responds to the polarity control signal and determines the polarity of the pixel voltage signals supplied to the data lines (DL1 to DL6). Thus, the pixel voltage signals supplied to each data line through the second MUX array 30 has the polarity contrary to adjacent pixel voltage signals. In other words, the pixel voltage signals on odd-numbered ones of the data lines (DLodd), such as DL1, DL3, DL5, and the pixel voltage signals provided to even-numbered ones of the data lines (DLeven), such as DL2, DL4, DL6, have contrary polarities to each other. In addition, the polarity of the odd-numbered ones of the data lines (DLodd) and the even-numbered ones of the data lines (DLeven) are periodically inverted for each horizontal period (1H) where the gate lines (GL1, GL2, GL3, . . . ) are sequentially driven, and in addition are inverted for each frame unit.

However, each of the data drive ICs 4 (in FIG. 1) should include an "N+1"-number of the DACs and the buffers in order to drive an N-number of the data lines. Thus, the data drive ICs 4 have a disadvantage in that their configuration is complicated and fabrication costs are relatively high.

SUMMARY OF THE INVENTION

Accordingly, the present invention is directed to a method and apparatus for driving a liquid crystal display device that substantially obviates one or more of the problems due to limitations and disadvantages of the related art.

An object of the present invention is to provide a method for driving a liquid crystal display device capable of decreasing a total number of data driver integrated circuit chips.

Another object of the present invention is to provide an apparatus for driving a liquid crystal display device for decreasing a total number of data driver integrated circuit chips.

Another object of the present invention is to provide a method for driving a liquid crystal display device to compensate for pixel voltage differences.

Another object of the present invention is to provide an apparatus for driving a liquid crystal display device to compensate for pixel voltage differences.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving apparatus of a liquid crystal display device includes a multiplexer array for performing time-division on inputted pixel data to supply time-divided pixel data, a digital-to-analog converter array for converting the time-divided pixel data into pixel voltage signals, and a demultiplexer array for driving data lines in a time-division manner to supply the converted pixel voltage signals, wherein the digital-to-analog converter array receives a plurality of pixel voltage signal levels inputted from an external source and generates the pixel voltage signals using the pixel voltage signal level with a voltage at least one-step higher in absolute value than the original pixel voltage signal level in correspondence to at least one pixel data.

In another aspect, a method for driving a liquid crystal display device includes performing time-division on pixel data inputted from an external source to output time-divided pixel data, converting the time-divided pixel data into pixel voltage signals, and performing time-division on data lines to supply the converted pixel voltage signals thereto, wherein the step of converting the pixel data into the pixel voltage signals includes generating the pixel voltage signals using a pixel voltage signal level having a voltage at least one step higher in absolute value than an original pixel voltage signal level in correspondence to at least one pixel data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrates embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 6:
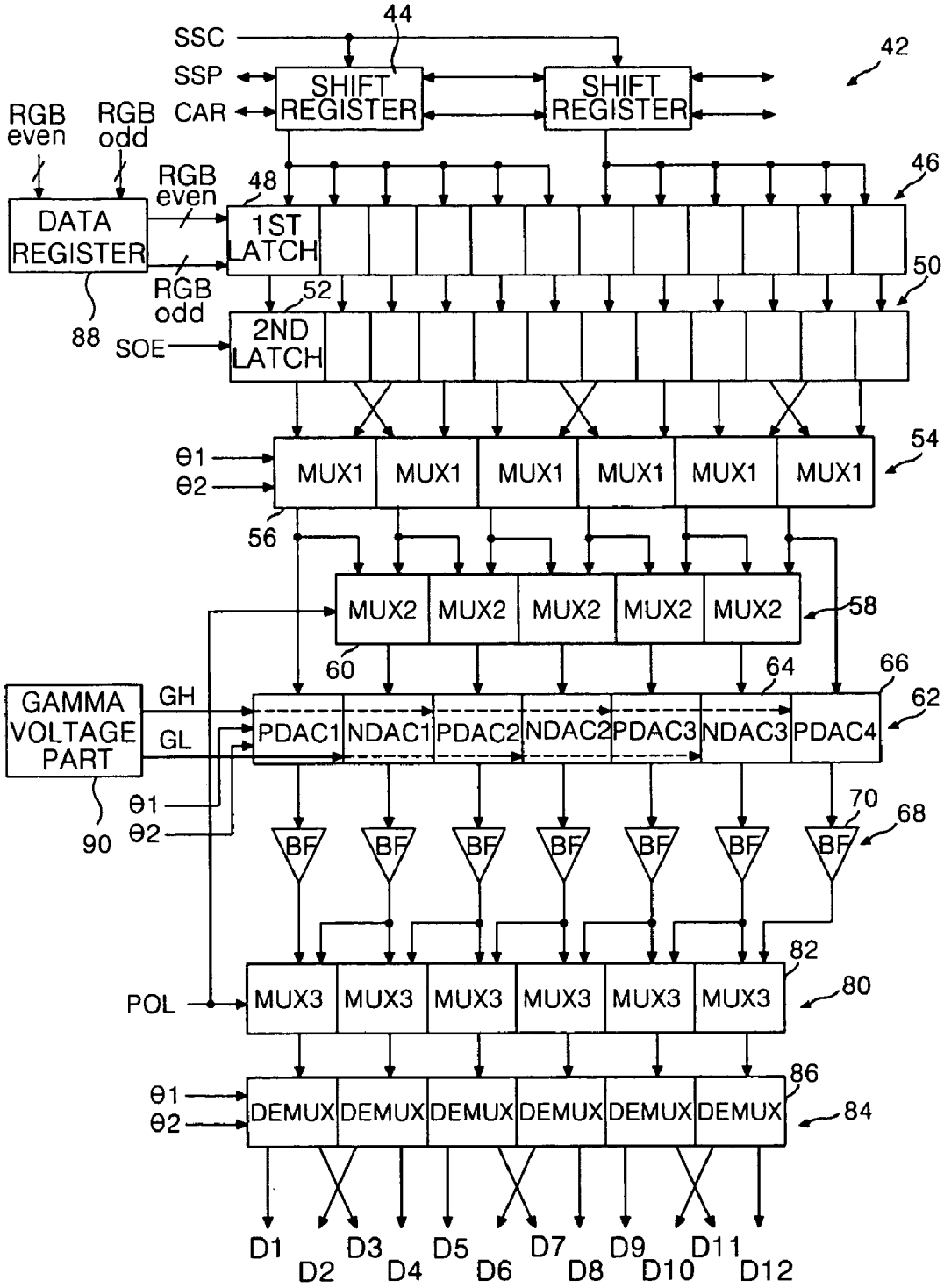
FIG. 6 is a schematic block diagram of an exemplary data drive IC according to the present invention.
Figure 7A:
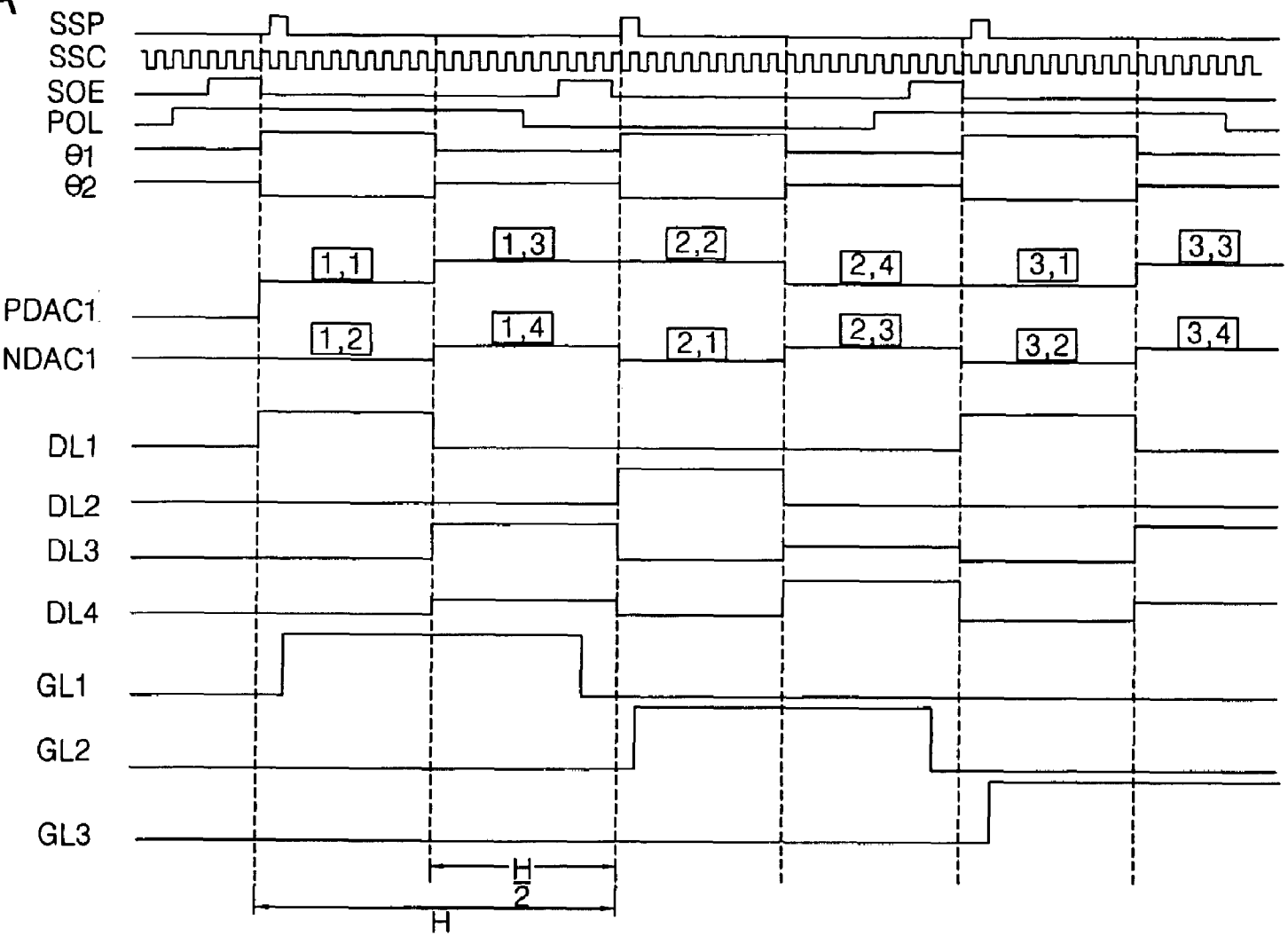
FIG. 7A is a diagram of an exemplary odd frame driving waveform of the data drive IC of FIG. 6 according to the present invention.
Figure 7B:
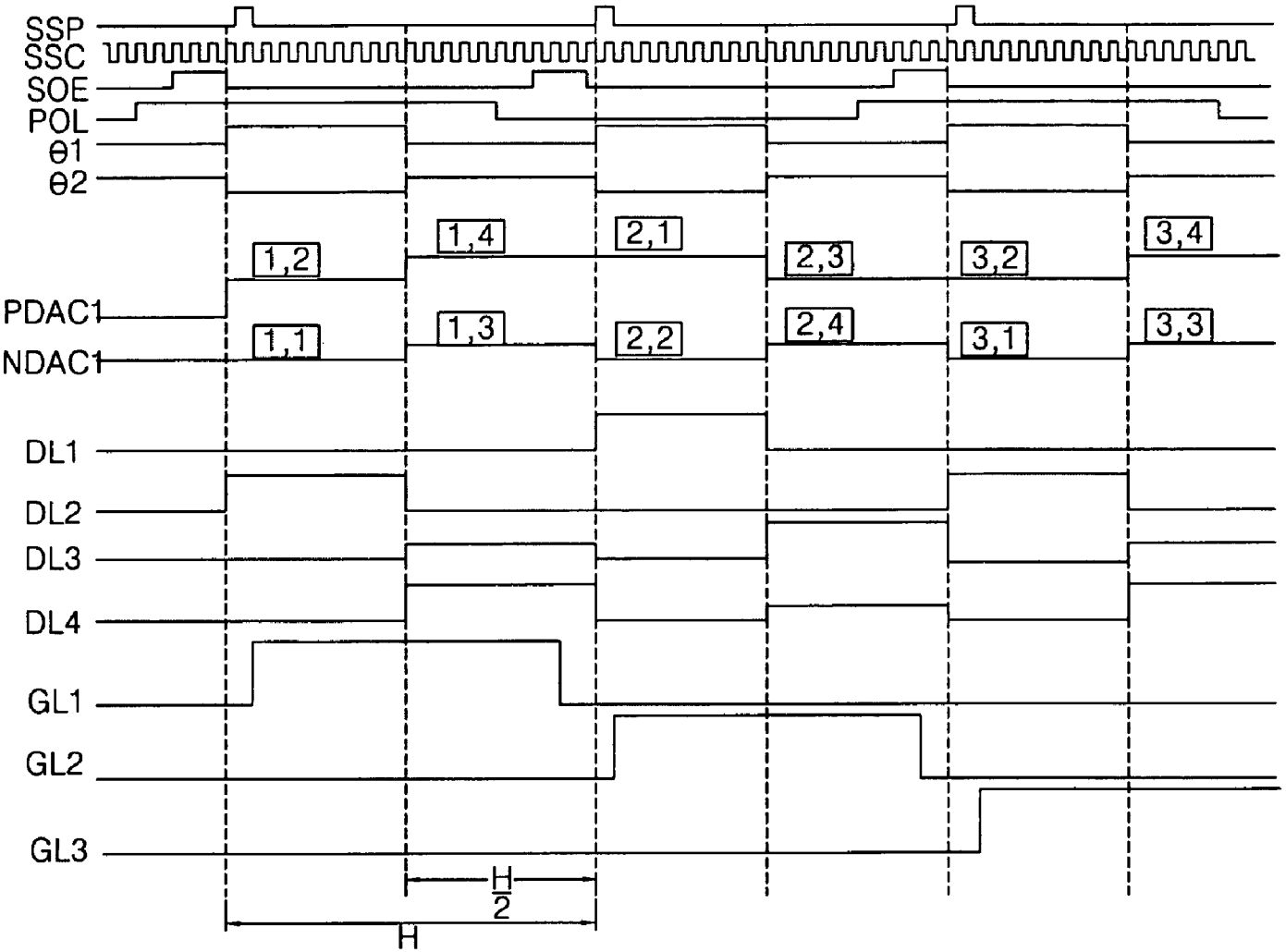
FIG. 7B is a diagram of an exemplary even frame driving waveform of the data drive IC of FIG. 6 according to the present invention.

FIG. 6 is a schematic block diagram of an exemplary data drive IC according to the present invention, FIG. 7A is a diagram of an exemplary odd frame driving waveform of the data drive IC of FIG. 6 according to the present invention, and FIG. 7B is a diagram of an exemplary even frame driving waveform of the data drive IC of FIG. 6 according to the present invention. In FIG. 6, a data drive IC may comprise a shift register array 42 for supplying sequential sampling signals, first and second latch arrays 46 and 50 for latching pixel data (R,G,B) in response to the sampling signals, a first MUX array 54 for performing time-division on the pixel data (R,G,B) from the second latch array 50, a second MUX array 58 for controlling a proceeding path of the pixel data (R,G,B) supplied from the first MUX array 54, a DAC array 62 for converting the pixel data (R,G,B) from the second MUX array 58 into pixel voltage signals, a buffer array 68 for buffering the pixel voltage signals from the DAC array 62, a third MUX array 80 for controlling the proceeding path of the outputs of the buffer array 68, and a DEMUX array 84 for performing time-division on the pixel voltage signals from the third MUX array 80 to data lines (DL1 to DL12). In addition, the data drive IC may comprise a data register 88 for relaying the pixel data (R,G,B) supplied from a timing controller (not shown) and a gamma voltage part 90 for supplying positive and negative gamma voltages necessary to the DAC array 62.

The data drive IC may drive a 2N-number of data lines using NDACs 64 and PDACs 66, and an "N+1"-numbers of buffers 70 by means of time-division driving the DAC array 62 using the first MUX array 54 and the DEMUX array 84. Accordingly, the data drive IC may have a 2N-number of channels of data outputs in order to drive the 2N-number of the data lines. For example, in FIG. 6, only 12 channels (DL1 to DL12) are shown assuming that N=6.

The data register 88 relays the pixel data from the timing controller and supplies it to the first latch array 46. Specially, the timing controller divides the pixel data into even pixel data (RGBeven) and odd pixel data (RGBodd) to lower the transmittance frequency and supplies them to the data register 88 through transmittance lines. The data register 88 provides the even pixel data (RGBeven) and the odd pixel data (RGBodd) to the first latch array 46 through each of the transmittance lines. For example, each of the even pixel data (RGBeven) and the odd pixel data (RGBodd) may include red (R), green (G), and blue (B) pixel data.

The gamma voltage part 90 sub-divides a plurality of gamma reference voltages received from a gamma reference voltage generator (not shown) by gray levels and provides the sub-divided gamma reference voltages. For example, similar to FIG. 3, the gamma reference voltage generator generates the gamma reference voltages (GMA1 to GMA10) being divided by 10 steps into 64 steps of entire gray level range and supplies them to the gamma voltage part 90. More specifically, the gamma reference voltage generator generates positive gamma reference voltages (GMA1 to GMA5) and negative gamma reference voltages (GMA6 to GMA10) by dividing a supply voltage provided from an external power supply for reference power supply. When dividing the entire gray level by 5 steps, the gamma reference voltages (GMA1 to GMA10) become gamma compensation voltages corresponding to each of the steps.

Figure 4:
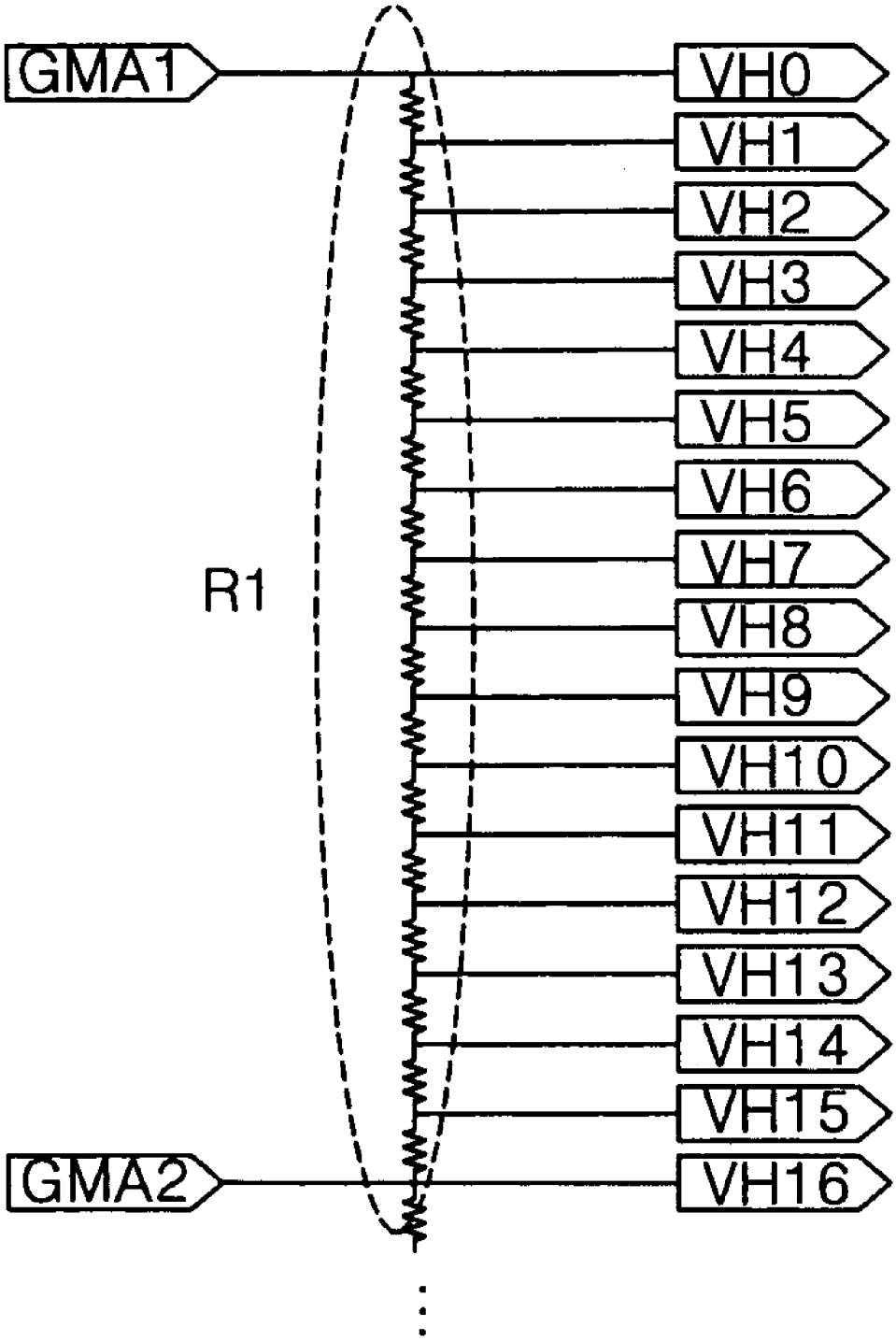
FIG. 4 RELATED ART
FIG. 4 is a schematic circuit diagram of a gamma voltage part according to the related art.

The gamma voltage part 90, similar to FIG. 4, voltage-divides the gamma reference voltages (GMA1 to GMA10) and generates the gamma compensation voltages (VH0, VH1, . . . ) corresponding to the gray level sub-divided between the gamma reference voltages (GMA1 to GMA 10). For this purpose, the gamma voltage part 90 comprises a plurality of resistors connected in series between the gamma reference voltages of adjacent steps (GMA1 to GMA10), and more specifically, between GMA1 and GMA2, between GMA2 and GMA3, . . . , and between GMA9 and GMA10. The gamma compensation voltages (VH0, VH1, . . . ) are generated as the gamma reference voltages being sub-divided by the registers arranged like this.

The shift register array 42 generates sequential sampling signals and supplies them to the first latch array 46 and for this purpose comprises a "2N/6"-number of the shift registers 44 (here, N=6). The shift register 44 of the first stage, as shown in FIG. 6, shifts a source start pulse (SSP) received from the timing controller in accordance with a source sampling clock signal (SSC) and provides it as sampling signals and at the same time supplies it as carry signal (CAR) to the shift register 44 of the next stage. The source start pulse (SSP), as shown in FIGS. 7A and 7B, is supplied by the horizontal period and is shifted by the source sampling clock signal (SSC) and is provided as a sampling signal.

The first latch array 46 samples and latches the pixel data (RGBeven, RGBodd) from the data register 88 by the same unit in response to the sampling signals from the shift register array 42. The first latch array 46 comprises a 2N-number of the first latches in order to latch the 2N-number of the pixel data (R,G,B) (here N=6) and each of the first latches 48 has a size corresponding to a bit number (i.e., 3 bit or 6 bit) of the pixel data (R,G,B). Thus, the first latch array 46 samples and latches the even pixel data (RGBeven) and the odd pixel data (RGBodd), namely the pixel data of 6 numbers for each sampling signal and then provides them at the same time.

The second latch array 50 latches the pixel data (R,G,B) from the first latch array 46 in response to the source output enable (SOE) from the timing controller at the same time and then provides them. The second latch array 50 comprises the 2N-number of the second latches 52 (here, N=6) identically to those of the first latch array 46. The source output enable (SOE), as shown in FIGS. 7A and 7B, is generated for each horizontal period.

The first MUX array 54 performs the time-division on the 2N-number of the pixel data (here, N=6) from the second latch array 50 on an N-by-N basis for each H/2 period in response to the first and the second selection control signals (θ1 , θ2) from the timing controller. For this purpose, the first MUX array 54 comprises the N-number of the first MUXs, and each of the first MUXs 56 selects an output of any one of two of the second latches 52 in the second latch array 50. In other words, each of the first MUXs 56 performs the time-division on the output of two second latches 52 for each 1/2 horizontal period.

For dot inversion driving, the odd first MUX 56 responds to the first selection control signal (θ1) and selects any one of outputs of the two odd second latches and the even first MUX 56 responds to the second selection control signal (θ2) and selects any one of outputs of the two even second latches 52. For example, the first MUX 56 of the first order responds to the first selection control signal (θ1) and in the first half of one horizontal term selects the first pixel data from the second latch 52 of the first order and provides it. In the second half the first MUX 56 of the first order selects the third pixel data from the second latch 52 of the third order and provides it. The first MUX 56 of the second order responds to the second selection control signal (θ2) and in the first half of one horizontal term selects the second pixel data from the second latch 52 of the second order and provides it. In the second half the first MUX 56 of the second order selects the fourth pixel data from the second latch 52 of the fourth order and provides it. The first and the second selection control signals θ1 and θ2, as shown in FIGS. 7A and 7B, have a polarity contrary to each other and their polarities are inverted for each horizontal term.

The second MUX array 58 responds to the polarity control signal (POL) from a polarity controller 92 and determines the proceeding path of the pixel data (R,G,B) supplied from the first MUX array 54. For this purpose, the second MUX array 58 comprises the "N−1"-number of the second MUXs 60, wherein each of the second MUXs 60 receives the outputs of two adjacent first MUX 56 and provides them selectively in accordance with the polarity control signal (POL). Accordingly, the output of each of the remaining first MUXs 56, except for the first MUXs 56 of the first and the last order, commonly receives the two adjacent second MUX 60. The output of the first MUXs 56 of the first and the last order is commonly received to the PDAC 66 and the second MUX 60. The second MUX array 58 having such a configuration controls in accordance with the polarity control signal (POL) so that the pixel data (R,G,B) from each of the first MUXs may be provided to the DAC array 62, or controls so that they may be provided to the DAC array 62 and shifted to the right line by line.

As shown in FIGS. 7A and 7B, for dot inversion driving, the polarity of the polarity control signal (POL) is inverted by the horizontal term. Subsequently, the second MUX array 58 controls the polarity of the pixel data (R,G,B) where each of the pixel data (R,G,B) from the first MUX array 54 responds to the polarity control signal (POL) by means of being provided to the PDAC 64 or the NDAC 66 disposed alternately in the DAC array 62. For example, the first and the third pixel data sequentially provided from the first MUX 56 of the first order in the first horizontal term are directly supplied to the PDAC1 66 and do not pass through the second MUX 60, and the second and the fourth pixel data sequentially provided from the first MUX 56 of the second order are supplied to NDAC1 64 by the second MUX 60 of the first order. In the second horizontal term, the first and the third pixel data are supplied to the NDAC1 64 by the second MUX 60 of the first order, and the second and the fourth pixel data are supplied to PDAC2 66 by the second MUX 60 of the second order.

The DAC array 62 converts the pixel data (R,G,B) from the second MUX array 58 into the pixel voltage signals using the positive and negative gamma voltages (GH(+VH),GL(−VH)) from the gamma voltage part 90. Specifically, the DAC array 62 provides some voltage of the positive and the negative gamma compensation voltages (GH,GL) in correspondence to the pixel data received from the second MUX array 58 to the pixel voltage signals. For example, the PDAC2 64 receives the first data from the second MUX array 58 provides VH6 voltage, as shown in FIG. 4, to the pixel voltage signals.

For this purpose, the DAC array 62 comprises the "N+1"-numbers of PDACs 66 and NDACs 64. For dot inversion driving, the PDAC 66 and the NDAC 64 are disposed alternately in parallel. The PDAC 66 converts the pixel data (R,G, B) from the second MUX array 58 into positive pixel voltage signals in using the positive gamma voltage (GH), and the NDAC 64 converts the pixel data (R,G,B) from the second MUX array 58 into negative pixel voltage signals using the negative gamma voltage (GL). Accordingly, the PDAC 66 and NDAC 64 convert the digital pixel data received foe each 1/2 horizontal term into analog pixel voltage signals.

As shown in FIGS. 7A and 7B, the PDAC1 66 converts the odd pixel data [1,1] and [1,3], which are time-divided in the first horizontal term, into the pixel voltage signals. At the same time, the NDAC 64 converts the even pixel data [1,2] and [1,4], which are time-divided in the first horizontal term, into the pixel voltage signals. Then, NDAC2 64 provides and converts the odd pixel data [2,1] and [2,3] provided as time-dividing in the second horizontal term into the pixel voltage signals. At the same time, PDAC2 66 converts the even pixel data [2,2] and [2,4] received as time-dividing in the second horizontal term into the pixel voltage signals. By the DAC array 62, the 2N-number of the pixel data are time-divided by an N-number for the 1/2 horizontal term and are provided as being converted into the pixel voltage signals. Each of the "N+1"-numbers of the buffers included in the buffer array 68 buffers the pixel voltage signals provided from each of the PDAC 66 and NDAC 64 of the DAC array 62.

The third MUX 80 responds to the polarity control signal (POL) from the timing controller and determines the proceeding path of the pixel voltage signal supplied from the buffer array 68. For this purpose, the third MUX array 80 comprises the N-number of the third MUXs 82 (here, N=6). Each of the third MUXs 82 responds to the polarity control signal (POL) and selects output of any one of two adjacent buffers 70. Here, the output stage of the remaining buffers 70, except for the first and the last buffers 70, commonly receives two adjacent third MUXs 82. The third MUX array 82 having such a configuration responds to the polarity control signal (POL) and provides the pixel voltage signals from each of the buffers 70, except for the last buffer 70, to its corresponding DEMUXs 86. Furthermore, the third MUX array 82 responds to the polarity control signal (POL) and provides the pixel voltage signals from each of the remaining buffers 70, except for the first buffer 70, provided to its corresponding DEMUXs 86. The polarity of the polarity control signal (POL), as shown in FIGS. 7A and 7B, is inverted for each horizontal term for dot inversion driving identically with what is supplied to the second MUX array 58. The third MUX array 80 responds to the polarity control signal (POL) and determines the polarity of the pixel voltage signals together with the second MUX array 58. As a result, the pixel voltage signals provided from the third MUX array 80 has the polarity contrary to adjacent pixel voltage signal and its polarity is inverted for each horizontal term.

Figure 5A:
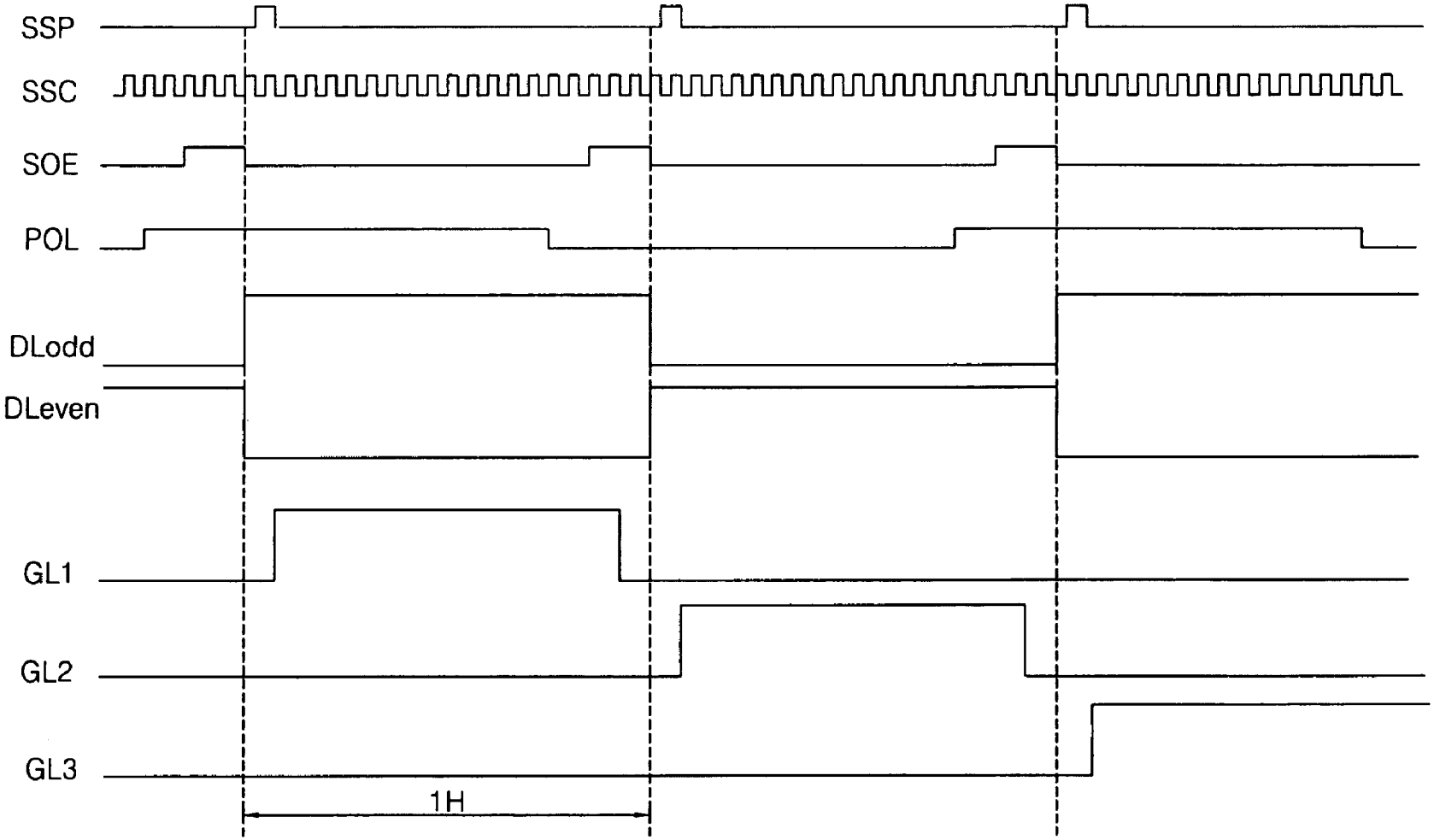
FIG.5A RELATED ART
FIG. 5A is diagram of an odd frame driving waveform of the data drive IC of FIG. 2 according to the related art.
Figure 5B:
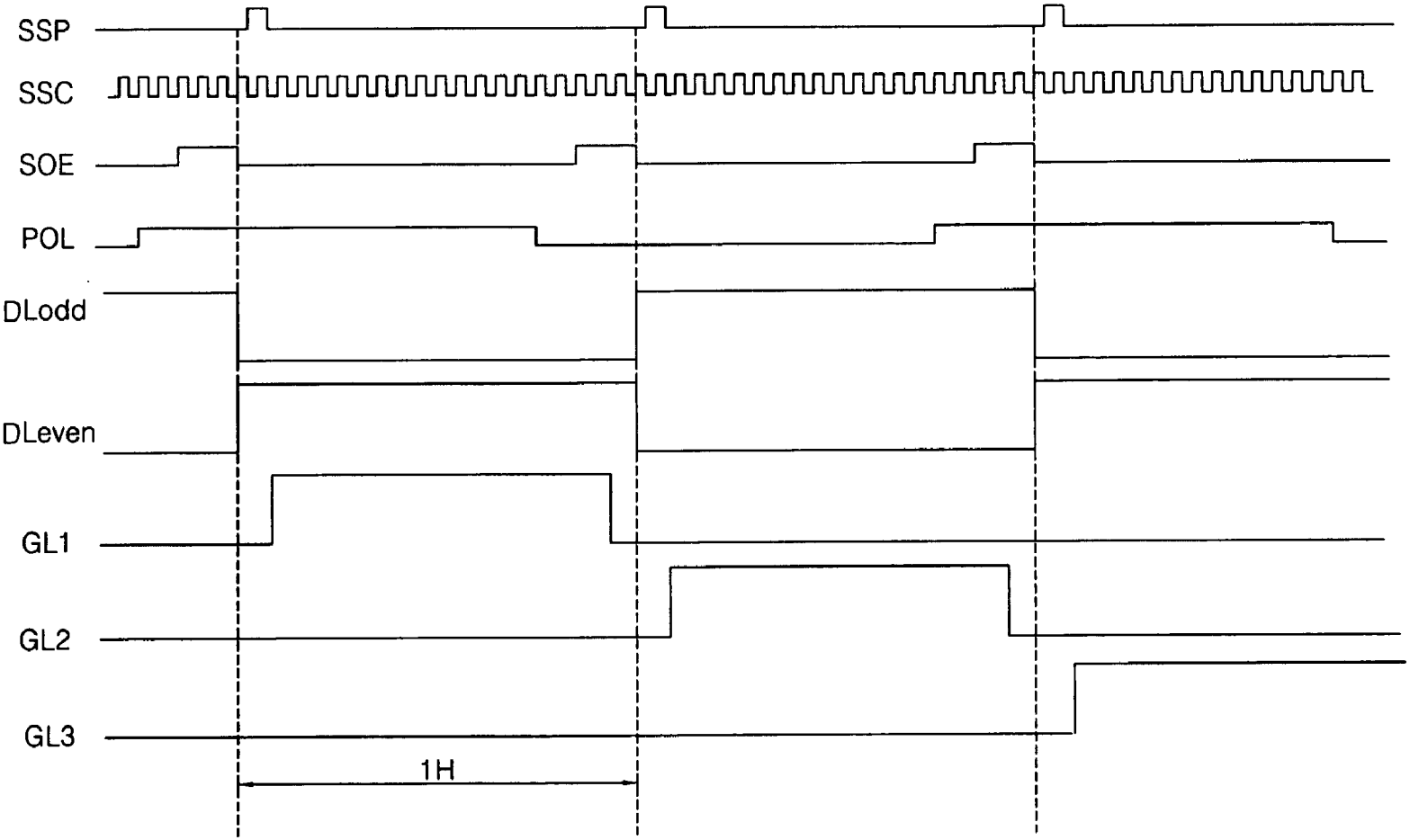
FIG.5B RELATED ART
FIG. 5B is a waveform diagram of an even frame driving waveform of the data drive IC of FIG. 2 according to the related art.

The DEMUX array 84 responds to the first and the second selection control signals θ1 and θ2 from the timing controller and selectively supplies the pixel voltage signal from the third MUX array 80 to a 2N-number of the data lines (here, N=6). For this purpose, the DEMUX array 84 comprises an N-number of the DEMUXs 86, wherein each of the DEMUXs 86 supplies and time-divides the pixel voltage signals supplied from each of the third MUX 82 to a set of the two data lines. For example, the odd DEMUX 86 responds to the first selection control signal θ1 and performs time-division on the output of the odd third MUX 82 to the two odd data lines. The even DEMUX 86 responds to the second selection control signal θ2 and supplies as time-dividing the output of the two even third MUX 82 to the two even data lines. The first and the second selection control signal θ1 and θ2, as shown in FIGS. 5A and 5B, have the polarity contrary to each other and their polarity are inverted for each horizontal term as similar as being supplied to the first MUX array 54.

As shown in FIGS. 7A and 7B, the DEMUX 86 of the first order responds to the first selection control signal θ1 and selectively supplies the output of the third MUX 82 of the first order for each 1/2 horizontal term to the first and the third data line. Similarly, the DEMUX 86 of the second order responds to the second selection control signal θ2 and selectively supplies the output of the third MUX 82 of the second order for each 1/2 horizontal term to the second and the fourth data lines.

More specifically, the DEMUX 86 of the first order responds to the first selection control signal θ1, and supplies the pixel voltage signal [1,1] to the first data line (DL1) in the first half of the first horizontal term in which the first gate line (GL1) is activated, and supplies the pixel voltage signal [1,3] to the third data line (DL3) in the second half. At the same time, the DEMUX 86 of the second order responds to the second selection control signal θ2, and supplies the pixel voltage signal [1,2] to the second data line (DL2) in the first half of the first horizontal term (H1), and supplies the pixel voltage signal [1,4] to the fourth data line (DL4) in the second half.

In addition, the DEMUX 86 of the first order supplies the pixel voltage signals [2,1] and [3,1] to the first data line (DL1) in the first half of each of the second horizontal term (H2) and the third horizontal term (H3), and supplies the pixel voltage signals [2,3] and [3,3] to the third data line (DL3) in the second half. The DEMUX 86 of the second order supplies the pixel voltage signals [2,2] and [3,2] to the second data line (DL2) in the first half of each of the second horizontal term (H2) and the third horizontal term (H3), and supplies the pixel voltage signals [2,4] and [3,4] to the fourth data line (DL4) in the second half.

By the data drive IC having such a configuration, the pixel voltage signals provided to the odd data lines, such as DL1 and DL2, and the pixel voltage signals provided to the even data lines, such as DL2 and DL4, as shown in FIGS. 7A and 7B, have polarities contrary to each other. In addition, the polarities of the odd data lines (DL1, DL3, . . . ) and the even data lines (DL2, DL4, . . . ) are inverted for each one horizontal period (1H) in which the gate lines (GL1, GL2, GL3, . . . ) are sequentially driven and in addition inverted by the frame.

As described above, the data drive IC according to the present invention can drive the data lines of a 2N-number of channels using a "N+1"-number of the DAC since the DAC array is time-division-driven. Alternatively, since each of the data drive ICs comprising the "N+1"-number of the DAC drives the 2N-number of the data lines, the number of DAC ICs is reduced by a one-half. On the other hand, since the present invention is divided in two one horizontal term (1H) and supplies respectively the pixel voltage signals in the first half and the second half, the problem arises in that the difference of the pixel voltage charging quantity between liquid crystal cells will occur.

Figure 8:
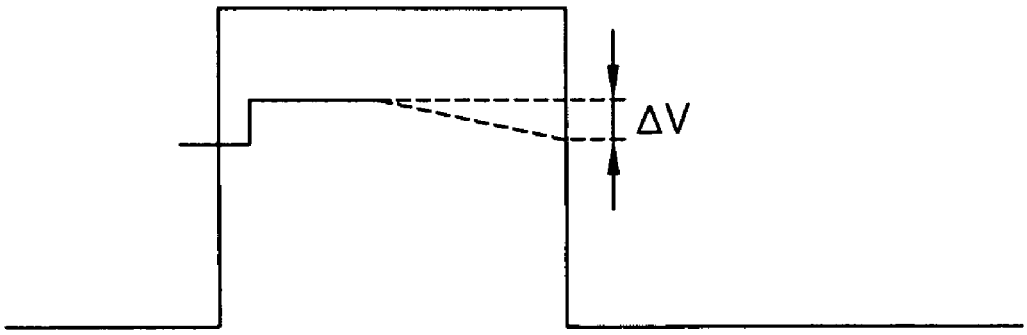
FIG. 8 is a schematic waveform diagram of an exemplary discharging process of a pixel voltage signal charged in a first half period according to the present invention.

FIG. 8 is a schematic waveform diagram of an exemplary discharging process of a pixel voltage signal charged in a first half period according to the present invention. In FIG. 8, liquid crystal cells supplied with a pixel voltage signal in a first half of one horizontal term float in a second half of the one horizontal term. Accordingly, during the second half of one horizontal term in which the liquid crystal cells float, the pixel voltage signals charged to the liquid crystal cell becomes discharged. Thus, if the pixel voltage signals charged in the first half of the liquid crystal cell is discharged in the second half of the liquid crystal cell, the voltage, which is lower than the desired voltage (as low as ΔV), becomes charged to the liquid crystal cell. Therefore, image quality of the liquid crystal display panel deteriorates.

To solve this problem, the DAC array 62 of the present invention provides the positive and the negative polarity gamma compensation voltages (GH,GL) having the voltage of absolute value higher than original voltages (preferably as high as ΔV) to the pixel voltage signals in correspondence to the pixel data (R,G,B) provided in the first half of one horizontal period of the pixel data (R,G,B) supplied from the first MUX array 54 and/or the second MUX array 58. Explaining this in full detail, the DAC array 62 is provided the pixel data (R,G,B) from the first MUX array 54 and/or the second MUX array 58. Then, the DAC array 62 provides the pixel voltage signals corresponding to the pixel data (R,G,B) of the pixel voltage signals received from the gamma voltage part 90. Thus, the DAC array 62 provides the pixel voltage signals having the absolute value voltage higher than the pixel voltage signals (at least more than one step) corresponding to the original pixel data (R,G,B) of the pixel voltage signal having a plurality of levels. For example, if the pixel voltage signals originally provided from the PDAC 64 to be received the first data is a VH6 voltage, as shown in FIG. 4, the PDAC 64 of the present invention provides the pixel voltage signals (VH5, VH4, . . . ) having the absolute value voltage level higher than the VH6 (at least more than one step) to pixel voltage signals.

As shown in FIG. 6, the DAC array 62 of the present invention receives further the selection control signal θ1 and θ2, in order to select the pixel data (R,G,B) provided in the first half of one horizontal period. More specifically, the DAC array 62 selects the pixel data (R,G,B) provided in the first half of one horizontal period in use of the selection control signal θ1 and θ2, and can compensate the difference of the pixel voltage charging quantity between liquid crystal cells by means of providing the pixel voltage signals having the absolute value voltage higher than that of original pixel voltage signals (at least more than one step) in correspondence to the selected data.

Further, in accordance with the present invention, one horizontal period is divided into four horizontal periods in order to compensate the difference of the pixel voltage charging quantity between liquid crystal cells.

Figure 9A:
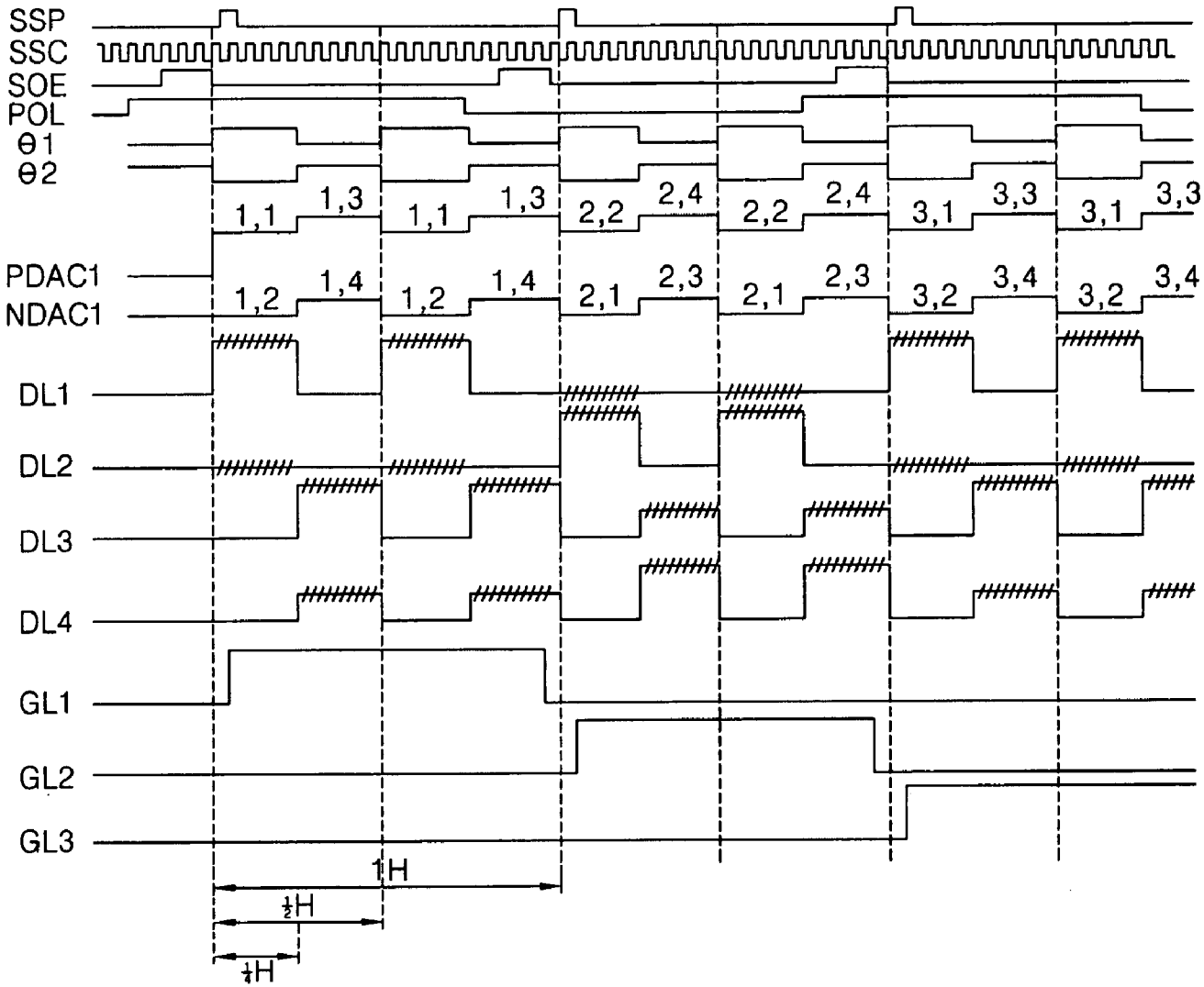
FIG. 9A is a diagram of another exemplary odd frame driving waveform of a data drive IC according to the present invention.
Figure 9B:
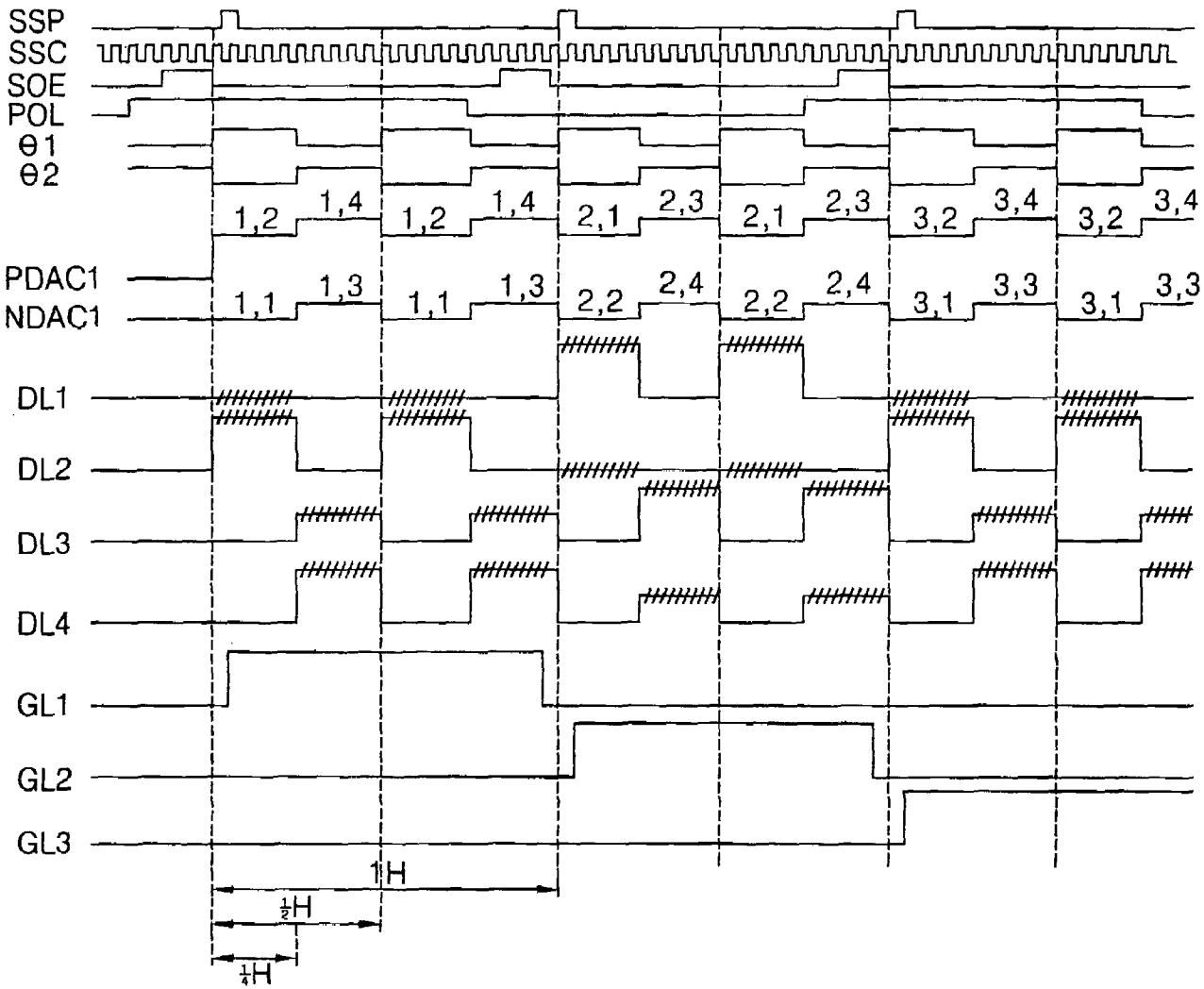
FIG. 9B is waveform of another exemplary even frame driving waveform of a data drive IC according to the present invention.

FIG. 9A is a diagram of another exemplary odd frame driving waveform of a data drive IC according to the present invention, and FIG. 9B is waveform of another exemplary even frame driving waveform of a data drive IC according to the present invention. In FIG. 6, the data drive IC comprises a shift register array 42 for supplying sequential sampling signals, a first and a second latch arrays 46 and 50 for latching pixel data (R,G,B) in response to the sampling signals, a first MUX array 54 for time-dividing and providing the pixel data (R,G,B) from a second latch array 50, a second MUX array 58 for controlling a proceeding path of the pixel data (R,G,B) supplied from the first MUX array 54, a DAC array for converting the pixel data (R,G,B) from the second MUX array 58 into pixel voltage signals, a buffer array 68 for buffering and providing a pixel voltage signals from a DAC array 62, a third MUX array 80 for controlling a proceeding path of a buffer array 68 output, and a DEMUX array 84 for time-dividing and providing pixel voltage signals from a third MUX array 80 to data lines (DL1 to DL12). In addition, the data drive IC comprises a data register 88 for relaying pixel data (R,G,B) supplied from the timing controller (not shown) and a gamma voltage part 90 for supplying positive and negative gamma voltages necessary in a DAC array 62.

The data register 88 relays the pixel data from the timing controller and supplies it to the first latch array 46. Specifically, the timing controller divides the pixel data into even pixel data (RGBeven) and odd pixel data (RGBodd) for lowering a transmittance frequency and supplies them to the data register 88 through transmittance lines. The data register 88 provides even pixel data (RGBeven) and odd pixel data (RGBodd) to the first latch array 46 through each of the transmittance lines. For example, each of the even pixel data (RGBeven) and odd pixel data (RGBodd) includes red (R), green (G), and blue (B) pixel data.

Figure 1:
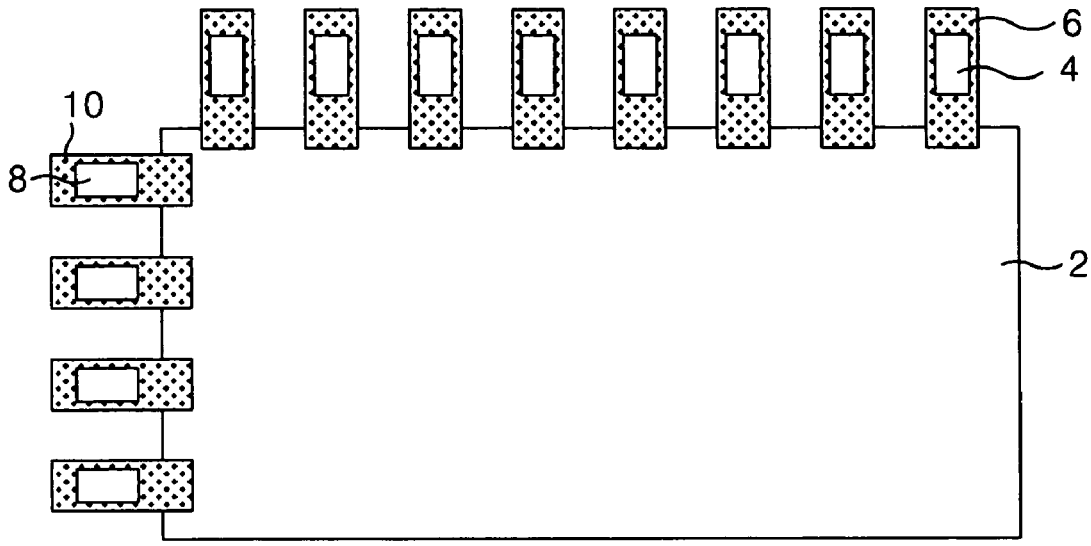
FIG. 1 RELATED ART
FIG. 1 is a schematic plan view of a liquid crystal display device according to the related art.
Figure 2:
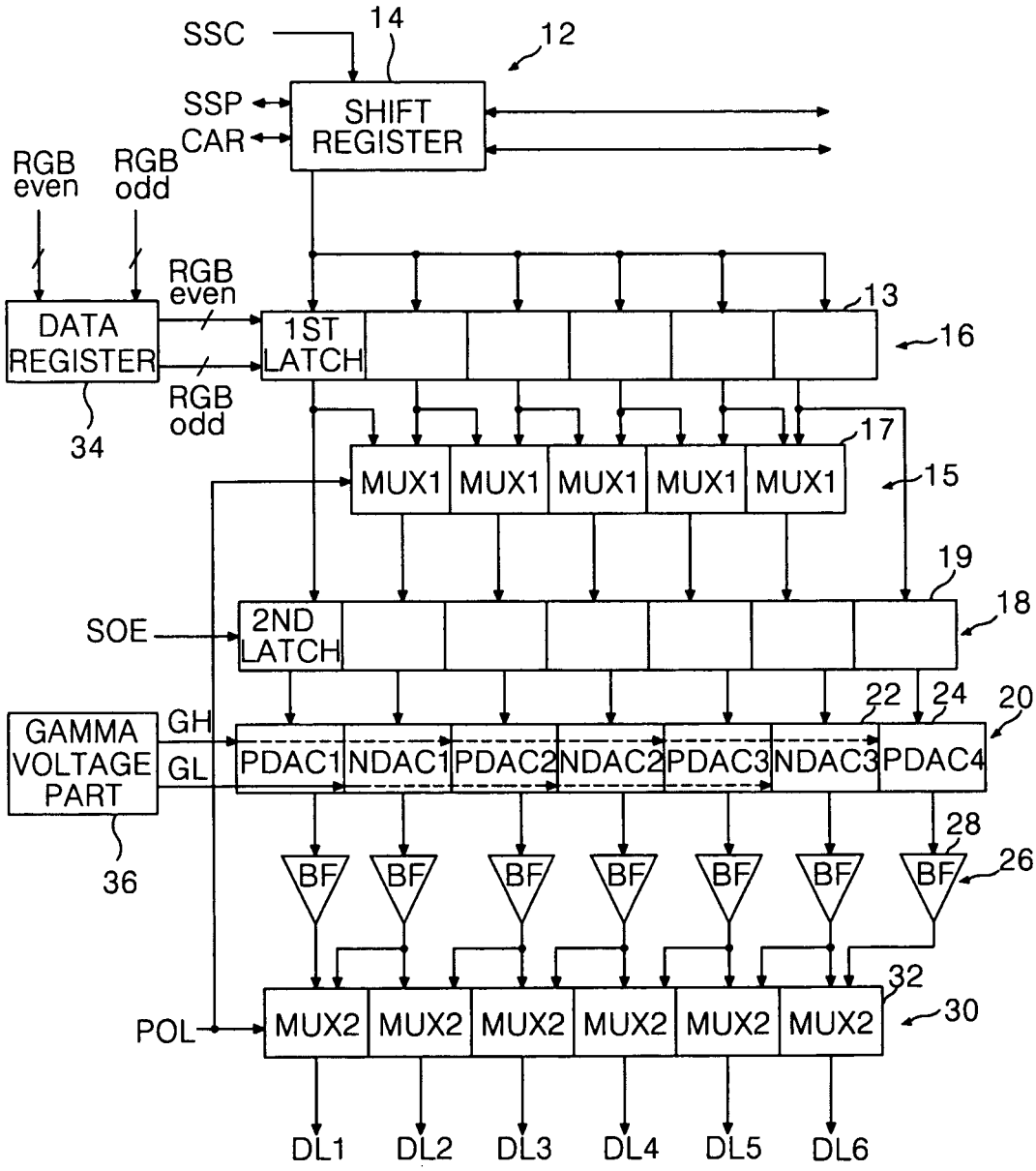
FIG.2 RELATED ART
FIG. 2 is a schematic block diagram of a data drive IC of FIG. 1 according to the related art.
Figure 3:
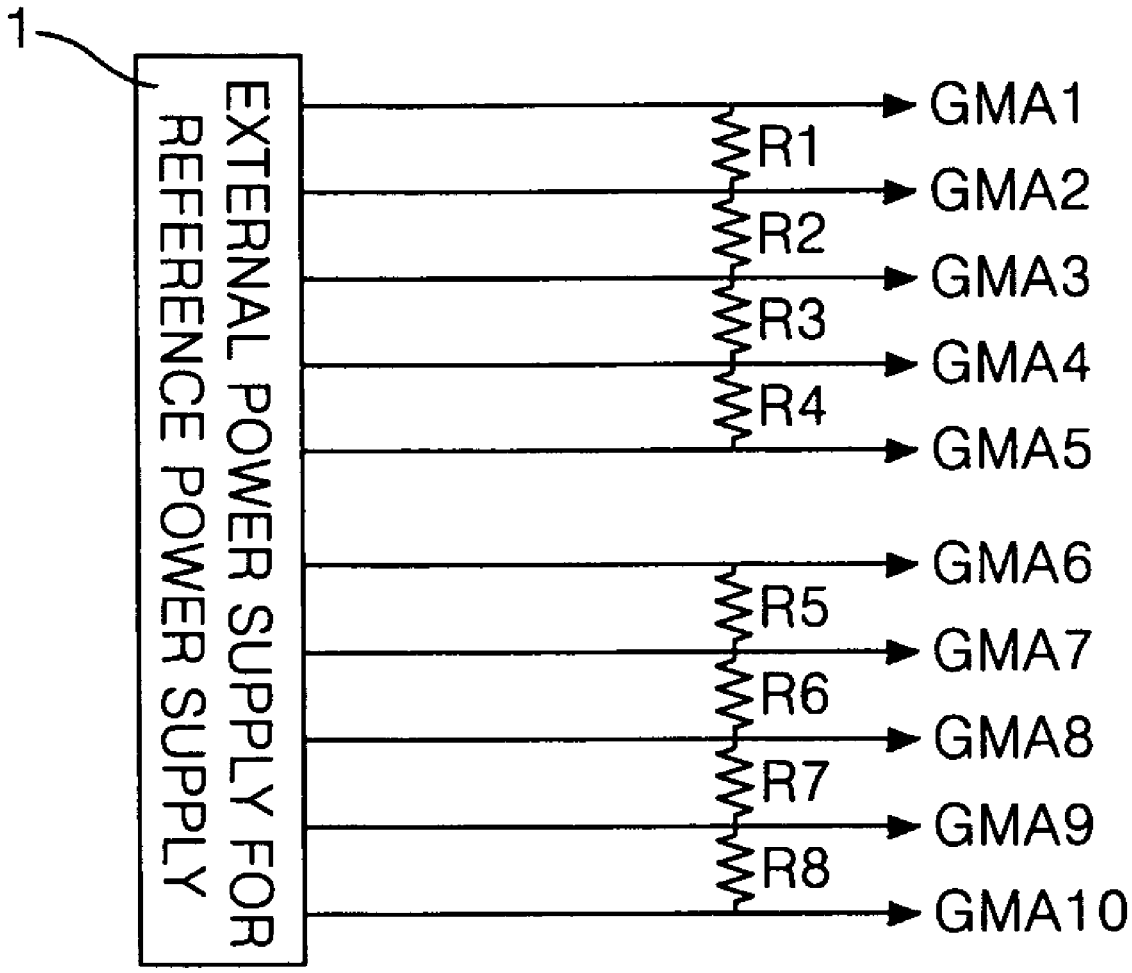
FIG. 3 RELATED ART
FIG. 3 is a schematic circuit diagram of a gamma reference voltage generator according to the related art.

The gamma voltage part 90 sub-divides a plurality of gamma reference voltages received from a gamma reference voltage generator (not shown) by the gray and provides them. Explaining this in full detail, the gamma reference voltage generator, as shown in FIG. 3, generates the gamma reference voltages (GMA1 to GMA10) being divided by 10 steps in full gray level range of 64 steps and supplies them to the gamma voltage part 36. More specifically, the gamma reference voltage generator generates positive gamma reference voltages (GMA1 to GMA5) and negative gamma reference voltages (GMA6 to GMA10) as voltage-dividing a supply voltage provided from an external power supply for the reference power supply. When dividing the entire gray level by 5 steps to represent, the gamma reference voltages (GMA1 to GMA10) are gamma compensation voltages corresponding to each of the steps.

The gamma voltage part 90, as shown in FIG. 4, divides the gamma reference voltages (GMA1 to GMA10) and generates the gamma compensation voltages (VH0, VH1, . . . ) corresponding to the gray levels sub-divided between gamma reference voltages (GMA1 to GMA 10). For this purpose, the gamma voltage part 90 comprises a plurality of resisters connected in series between the gamma reference voltages of adjacent steps (GMA1 to GMA10), and more specifically, between GMA1 and GMA2, between GMA2 and GMA3, . . . , and between GMA9 and GMA10. The gamma compensation voltages (VH0, VH1, . . . ) are generated as the gamma reference voltages being sub-divided by the registers.

The shift register array 42 generates sequential sampling signals and supplies them to the first latch array 46 and for this purpose, comprises a "2N/6"-number of the shift register 44 (here, N=6). The shift register 44 of the first stage, as shown in FIG. 6, shifts a source start pulse (SSP) received from the timing controller in accordance with a source sampling clock signal (SSC) and provides it as sampling signals and, at the same time, supplies it as carry signal (CAR) to the shift register 44 of the next stage. The source start pulse (SSP), as shown in FIGS. 9A and 9B, is supplied for each horizontal period and is shifted for each of the source sampling clock signal (SSC) and is provided as a sampling signal.

The first latch array 46 latches and samples the pixel data (RGBeven, RGBodd) from the data register 88 by a designated unit in response to the sampling signals from the shift register array 42. The first latch array 46 comprises a 2N-number of the first latches in order to latch a 2N-number of the pixel data (R,G,B) (here, N=6) and each of the first latches 48 has a size corresponding to a bit number (i.e., 3 bit or 6 bit) of the pixel data (R,G,B). Accordingly, the first latch array 46 latches and samples the even pixel data (RGBeven) and the odd pixel data (RGBodd) (i.e. 6 numbers of the pixel data for each sampling signal), and then provides all of them at the same time.

The second latch array 50 latches the pixel data (R,G,B) from the first latch array 46 at the same time in response to the source output enable (SOE) from the timing controller and then provides them. The second latch array 50 comprises the 2N-number of the second latches 52 (here, N=6) identically to those of the first latch array 46. The source output enable (SOE), as shown in FIGS. 9A and 9B, is generated by the horizontal period unit.

The first MUX array 54 provides and time-divides the 2N-number of the pixel data (here, N=6) from the second latch array 50 on an N-by-N basis for each of the H/4 period in response to the first and the second selection control signals θ1 and θ2 from the timing controller for its output. For this purpose, the first MUX array 54 is comprised of the N-number of the first MUXs, wherein each of the first MUXs 56 provides and selects an output of any one of two the second latches 52 in the second latch array 50. In other words, each of the first MUXs 56 supplies and time-divides output of the two second latches 52 for each 1/4 horizontal period.

Explaining this in full detail, for dot inversion driving, the first odd MUX 56 responds to the first selection control signal θ1 and provides and selects any one of outputs of the two odd second latches and the first even MUX 56 responds to the second selection control signal θ2 and provides and selects any one of outputs of the two even second latches 52. Here, the first selection control signal θ1 has a period of 1/2 horizontal term, and the second selection control signal θ2 also has a period of 1/2 horizontal term and in addition has a polarity contrary to that of the first selection control signal θ1. Accordingly, one horizontal term is driven as being divided by the 1/4 term for driving.

For example, the first MUX 56 of the first order responds to the first selection control signal θ1 and selects the first pixel data from the second latch 52 in the first 1/4 horizontal term (0~1/4) and the third 1/4 horizontal term (2/4~3/4) of one horizontal term and provides it. In addition, the first MUX 56 of the first order selects the third pixel data in the second 1/4 horizontal term (1/4~2/4) and the fourth 1/4 horizontal term (3/4~4/4) and provides it. The first MUX 56 of the second order responds to the second selection control signal θ2 and selects the second pixel data in the first 1/4 horizontal term (0~1/4) and the third 1/4 horizontal term (2/4~3/4) and provides it. The first MUX 56 of the second order selects the fourth pixel data in the second 1/4 horizontal term (1/4~2/4) and the fourth 1/4 horizontal term (3/4~4/4) and provides it.

The second MUX array 58 responds to the polarity control signal (POL) and determines the proceeding path of the pixel data (R,G,B) supplied from the first MUX array 54. For this purpose, the second MUX array 58 comprises an "N−1"-number of the second MUXs 60, wherein each of the second MUXs 60 receives the outputs of the two adjacent first MUX 56 and selectively provides one of them in accordance with the polarity control signal (POL). Here, the output of each of the remaining first MUXs 56 except for the first MUXs 56 of the first and the last order receives in common to the two adjacent second MUXs 60. The output of the first MUXs 56 of the first and the last order is commonly received to the PDAC 66 and the second MUX 60. The second MUX array 58 controls in accordance with the polarity control signal (POL) so that the pixel data (R,G,B) from each of the first MUXs may be proceeded to the DAC array 62 as it is, or controls so that they may be proceeded to the DAC array 62 as shifting to the right line by line. For dot inversion driving, the polarity of the polarity control signal (POL) is inverted for each horizontal term, as shown in FIGS. 5A and 5B. Therefore, the second MUX array 58 allows each of the pixel data (R,G,B) from the first MUX array 54 to respond to the polarity control signal (POL) by means of being provided to the PDAC 64 or the NDAC 66 disposed alternately in the DAC array 62.

For example, the first and the third pixel data sequentially provided from the first MUX 56 of the first order in the first horizontal term are supplied to the PDAC1 66 and do not directly pass through the second MUX 60. The second and the fourth pixel data sequentially provided from the first MUX 56 of the second order are supplied to NDAC1 64 by the second MUX 60 of the first order. In the second horizontal term, the first and the third pixel data are supplied to the NDAC1 64 by the second MUX 60 of the first order, and the second and the fourth pixel data are supplied to PDAC2 66 by the second MUX 60 of the second order.

The DAC array 62 provides and converts the pixel data (R,G,B) from the second MUX array 58 into the pixel voltage signal in use of the positive and the negative gamma voltages (GH(+VH),GL(−VH)) from the gamma voltage part 90. DAC array 62 provides some voltage of the positive and the negative gamma compensation voltages (GH,GL) in correspondence to the pixel data received from the second MUX array 58 to the pixel voltage signal. For example, the PDAC2 64, which was provided the first data from the second MUX array 58, provides a VH6 voltage, as shown in FIG. 4, as the pixel voltage signals.

For this purpose, the DAC array 62 comprises an "N+1"-number of PDAC 66 and NDAC 64. For dot inversion driving, the PDAC 66 and the NDAC 64 are disposed alternately in parallel, wherein the PDAC 66 converts the pixel data (R,G,B) from the second MUX array 58 into positive pixel voltage signals using positive gamma voltage (GH). The NDAC 64 converts the pixel data (R,G,B) from the second MUX array 58 into negative pixel voltage signals using negative gamma voltage (GL). Such PDAC 66 and NDAC 64 convert the digital pixel data provided by the 1/4 horizontal term into analog pixel voltage signals. Each of an "N+1"-number of the buffers included in the buffer array 68 provides as signal-buffering the pixel voltage signal provided from each of the PDAC 66 and NDAC 64 of the DAC array 62.

The third MUX 80 responds to the polarity control signal (POL) from the timing controller and determines the proceeding path of the pixel voltage signal supplied from the buffer array 68. For this purpose, the third MUX array 80 comprises an N-number of the third MUXs 82 (here, N=6). Each of the third MUXs 82 responds to the polarity control signal (POL) and selects output of any one of two adjacent buffers 70. Here, the output stage of the remaining buffers 70, except for the first and the last buffer 70, are commonly received to the two adjacent third MUXs 82. The third MUX array 82 responds to the polarity control signal (POL) and permits the pixel voltage signals from each of the buffers 70, except for the last buffer 70, to be provided as corresponding to the DEMUXs 86. Further, the third MUX array 82 responds to the polarity control signal (POL) and permits the pixel voltage signal from each of the remaining buffers 70, except for the first buffer 70, to be provided as corresponding to the DEMUXs 86. The polarity of the polarity control signal (POL), as shown in FIGS. 9A and 9B, inverted by the horizontal term for dot inversion driving as similar as the second MUX array 58. The third MUX array 80 like this responds to the polarity control signal (POL) and determines the polarity of the pixel voltage signal as well as the second MUX array 58. As a result, the pixel voltage signals provided from the third MUX array 80 have polarities contrary to adjacent pixel voltage signals and the polarities are inverted for each horizontal term.

The DEMUX array 84 responds to the first and the second selection control signal θ1 and θ2 from the timing control signal and selectively supplies the pixel voltage signals from the third MUX array 80 to the 2N-number of the data lines (here, N=6). For this purpose, the DEMUX array 84 comprises the N-number of the DEMUXs 86, wherein each of the DEMUXs 85 supply and time-divide the pixel voltage signals supplied from each of the third MUX 82 to the two data lines. Explaining this in full detail, the odd DEMUX 86 responds to the first selection control signal θ1 and supplies and time-divides the output of the odd third MUX 82 to the two odd data lines. The even DEMUX 86 responds to the second selection control signal θ2 and performs the time-division on the output of the two even third MUX 82 to the two even data lines. The first and the second selection control signal θ1 and θ2, as shown in FIGS. 9A and 9B, have the 1/4 horizontal term period, and in addition have polarities contrary to each other as similar as applying to the first MUX array 54.

For example, the DEMUX 86 of the first order, as shown in FIGS. 5A and 5B, responds to the first selection control signal θ1 and selectively supplies the output of the third MUX 82 of the first order for each 1/4 horizontal term to the first and the third data lines. Similarly, the DEMUX 86 of the second order also, as shown in FIGS. 9A and 9B, responds to the second selection control signal θ2 and selectively supplies the output of the third MUX 82 of the second order for each 1/4 horizontal term to the second and the fourth data lines DL2 and DL4.

More specifically, the DEMUX 86 of the first order responds to the first selection control signal θ1, and supplies the pixel voltage signal [1,1] to the first data line (DL1) during the first 1/4 horizontal term (0~1/4) and the second 1/4 horizontal term (2/4~3/4) of the first horizontal term in which the first gate line (GL1) is activated, and supplies the pixel voltage signal [1,3] to the third data line (DL3) during the second 1/4 horizontal term (1/4~2/4) and the fourth 1/4 horizontal term (3/4~4/4). At the same time, the DEMUX 86 of the second order responds to the second selection control signal θ2, and supplies the pixel voltage signal [1,2] to the second data line (DL2) during the first 1/4 horizontal term (0~1/4) and the third 1/4 horizontal term (2/4~3/4) of the first horizontal term, and supplies the pixel voltage signal [1,4] to the fourth data line (DL4) during the second 1/4 horizontal term (1/4~2/4) and the fourth 1/4 horizontal term (3/4~4/4).

The DEMUX 86 of the first order supplies the pixel voltage signals [2,1] and [3,1] to the first data line (DL1) during the first 1/4 horizontal term (0~1/4) and the third 1/4 horizontal term (2/4~3/4) of the second horizontal term (H2) and the third horizontal term (H3), and supplies the pixel voltage signals [2,3] and [3,3] to the third data line (DL3) during the second 1/4 horizontal term (1/4~2/4) and the fourth 1/4 horizontal term (3/4~4/4). The DEMUX 86 of the second order supplies the pixel voltage signals [2,2] and [3,2] to the first data line (DL1) during the first 1/4 horizontal term (0~1/4) and the third 1/4 horizontal term (2/4~3/4) of the second horizontal term (H2) and the third horizontal term (H3), and supplies the pixel voltage signals [2,4] and [3,4] to the third data line (DL3) during the second 1/4 horizontal term (1/4~2/4) and the fourth 1/4 horizontal term (3/4~4/4).

By the data drive IC having such a configuration, the pixel voltage signal provided to the odd data lines DL1 and DL2, and the pixel voltage signals provided to the even data lines DL2 and DL4, as shown in FIGS. 9A and 9B, have a polarity contrary to each other. The polarity of the odd data lines (DL1, DL3, . . . ) and the even data lines (DL2, DL4, . . . ) are inverted for each one horizontal period (1H) and in addition inverted for the frame. Namely, in accordance with the present invention, one horizontal term is divided in four. Then, in the first and the third 1/4 term, the pixel voltage signals are supplied, or in the second and the fourth 1/4 term the pixel voltage signals are supplied.

On the other hand, in accordance with the present invention, since the present invention divides in four one horizontal term (1H) and respectively supplies the pixel voltage signals in the first and the third 1/4 horizontal term and in the second and the fourth 1/4 horizontal term, the problem arises in that the difference of the pixel voltage charging quantity between liquid crystal cells may induced.

Figure 10:
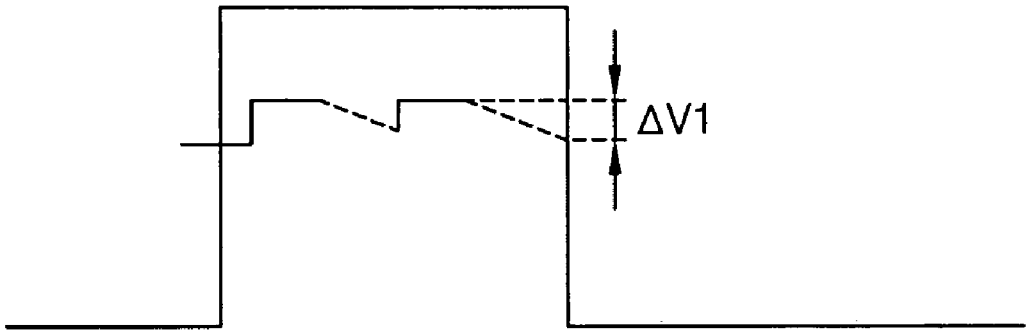
FIG. 10 is a schematic waveform diagram of another exemplary discharging process of a pixel voltage signal according to the present invention.

FIG. 10 is a schematic waveform diagram of another exemplary discharging process of a pixel voltage signal according to the present invention. In FIG. 10, in the first and the third 1/4 horizontal term of one horizontal term, the liquid crystal cells supplied the pixel voltage float in the second and the fourth 1/4 horizontal term. Accordingly, in the second and the fourth 1/4 horizontal term in which the liquid crystal cells float, the pixel voltage signals charged to the liquid crystal cell becomes discharged. As described above, if the pixel voltage charged to liquid crystal cell in the second and the fourth 1/4 horizontal term are discharged, the voltage that is lower than a desired voltage (as low as ΔV1) becomes charged to the liquid crystal cell. Thus, image quality of the liquid crystal display panel deteriorates.

To solve this problem, the DAC array 62 of the present invention provides the positive and negative polarity gamma compensation voltages (GH,GL) having the voltage of absolute value higher than that of original voltage (preferably as high as ΔV) as the pixel voltage signal in correspondence to the pixel data (R,G,B) provided in the first and the third 1/4 horizontal term of the pixel data (R,G,B) supplied from the first MUX array 54 and/or the second MUX array 58. Explaining this in full detail, the DAC array 62 is provided the pixel data (R,G,B) from the first MUX array 54 and/or the second MUX array 58. Then, the DAC array 62 receives the pixel voltage signal corresponding to the pixel data (R,G,B) of the pixel voltage signal provided from the gamma voltage part 90. At this time, the DAC array 62 provides the pixel voltage signal having the absolute value voltage higher than that of the pixel voltage signal (at least more than one step) corresponding to the original pixel data (R,G,B) of the pixel voltage signal having a plurality of levels. For example, if the pixel voltage signal originally provided from the PDAC 64 receiving the first data is a VH6 voltage, as shown in FIG. 4, the PDAC 64 of the present invention provides the pixel voltage signal (VH5, VH4, . . . ) having the absolute value voltage level higher than the VH6 (at least more than one step) as pixel voltage signal.

On the other hand, the DAC array 62 of the present invention further receives the selection control signal θ1 and θ2, as shown in FIG. 6, in order to select the pixel data (R,G,B) provided in the first and the third 1/4 horizontal term of one horizontal period. More specifically, the DAC array 62 selects the pixel data (R,G,B) provided in the first and the third 1/4 horizontal term of one horizontal period in use of the selection control signal θ1 and θ2, and can compensate the difference of the pixel voltage charging quantity between liquid crystal cells by means of providing the pixel voltage signal having the absolute value voltage higher than original pixel voltage signal (at least more than one step) in correspondence to this pixel data.

As described above, the data driving apparatus and the method of the liquid crystal display according to the present invention can drive the data lines of at least a 2N-number using a "N+1"-number of the DAC by means of time-division-driving the DAC part. Therefore, in accordance with the data driving apparatus and the method of the liquid crystal display of the present invention, it is possible to reduce the number of the data drive IC as half as that of the prior art which leads the reduction of fabrication cost.

Further, the data driving apparatus and the method of the liquid crystal display according to the present invention can compensate the difference of charging quantity between liquid crystal cells by means of providing the pixel voltage signal having the voltage level higher than original voltage level in correspondence to the pixel data.

It will be apparent to those skilled in the art that various modification and variations can be made to the present invention without departing from the spirit or scope of the invention. Thus, it is intended that the present invention cover the modifications and variations of this invention provided they come within the scope of the appended claims and their equivalents.

What is claimed is:

1. A driving apparatus of a liquid crystal display device, comprising:

a shift register array for sequentially generating a sampling signal;

a data register for providing pixel data to a latch array through each of transmittance lines;

wherein the latch array for sequentially latches the pixel data by designated units in response to the sampling signal to simultaneously output the latched pixel data to a first multiplexer array, the pixel data including even pixel data (RGB even) and odd pixel data (RGB odd);

the first multiplexer array for performing time-division on inputted pixel data to supply time-divided pixel data signals, wherein the first multiplexer array performs at least one time-division each horizontal period;

a digital-to-analog converter array for converting the time-divided pixel data signals into pixel voltage signals; and a demultiplexer array for driving data lines in a time-division manner to supply the converted pixel voltage signals, wherein the digital-to-analog converter array receives a first time-divided pixel data signal from the multiplexer array and generates a first pixel voltage signal level having a first voltage value corresponding to the first time-divided pixel data signal, generates a second pixel voltage signal level having a voltage at least one-step higher in absolute value than the first pixel voltage signal level and corresponding to the first time-divided pixel data signal, wherein the pixel data include even pixel data (RGB even) and odd pixel data (RGB odd).

2. The driving apparatus according to claim 1, further comprising:

a buffer array for buffering the pixel voltage signal to supply the buffered signal to the demultiplexer array.

3. The driving apparatus according to claim 1, wherein the first multiplexer array includes at least an N-number (N is a positive integer) of multiplexers and performs time-division on a plurality of input pixel data to supply the time-divided pixel data, the digital-to-analog converter array converts the time-divided pixel data into the pixel voltage signals, and the demultiplexer array includes at least an N-number of demultiplexers and supplies the pixel voltage signals to a plurality of data lines.

4. The driving apparatus according to claim 3, wherein the digital-to-analog converter array includes:

at least an "N+1"-number of positive and negative digital-to-analog converters for converting the time-divided pixel data into the pixel voltage signals, wherein the positive and negative digital-to-analog converters are alternately arranged.

5. The driving apparatus according to claim 4, further comprising:

a second multiplexer array for determining a progress path of the time-divided pixel data in response to an input polarity control signal to make the time-divided pixel data inputted to at least an N-number of positive and negative digital-to-analog converters among at least the N-number of positive and negative digital-to-analog converters; and a third multiplexer array for determining a progress path of the pixel voltage signal in response to the polarity control signal to make the pixel voltage signal inputted to the demultiplexer array.

6. The driving apparatus according to claim 5, wherein the second multiplexer array includes at least an "N-1"-number of second multiplexers for selecting any one among outputs of at least two of the first multiplexers, the third multiplexer array includes at least an N-number of third multiplexers for selecting any one among outputs of at least two of the digital-to-analog converters, and an output of each of the first multiplexers is commonly inputted to at least the two of the second multiplexers, and an output of each of the digital-to-analog converters is commonly inputted to at least the two of the third multiplexers.

7. The driving apparatus according to claim 3, wherein the N-number of the first multiplexers include an odd-numbered multiplexer performs time-division on odd-numbered pixel data in response to an inputted first selection control signal to output the time-divided data, and an even-numbered multiplexer performs time-division on even-numbered pixel data in response to an inputted second selection control signal to output the time-divided data.

8. The driving apparatus according to claim 7, wherein the N-number of the demultiplexers include an odd-numbered demultiplexer performs time-division on odd-numbered data lines in response to the first selection control signal to drive the time-divided data lines, and an even-numbered demultiplexer performs time-division on even-numbered data lines in response to the second selection control signal to drive the time-divided data lines.

9. The driving apparatus according to claim 8, wherein the first and second selection control signals have a logical state opposite to each other, and the logical state is inverted at least for each half horizontal period.

10. The driving apparatus according to claim 9, wherein the digital-to-analog converter array generates the pixel voltage signal in use of the pixel voltage signal level having a voltage at least one step higher in absolute value than the original pixel voltage signal level in correspondence to the pixel data outputted during the first half of one horizontal period, and generates the pixel voltage signal in use of the original pixel voltage signal level in correspondence to the pixel data outputted during the second half of the one horizontal period.

11. The driving apparatus according to claim 8, wherein the first and second selection control signals have a logical state opposite to each other, and the logical state is inverted at least for each quarter horizontal period.

12. The driving apparatus according to claim 11, wherein the digital-to-analog converter array generates the pixel voltage signal in use of the pixel voltage signal level having a voltage at least one step higher in absolute value than the original pixel voltage signal level in correspondence to the pixel data outputted during the first and third quarters of one horizontal period, and generates the pixel voltage signal in use of the original pixel voltage signal level in correspondence to the pixel data outputted during the second and fourth quarters of the one horizontal period.

13. A method for driving a liquid crystal display device, comprising the steps of:

supplying pixel data from an external source;

performing time-division on the pixel data inputted from the external source to output time-divided pixel data, wherein the step of performing time-division includes performing at least one time-division each horizontal period;

converting the time-divided pixel data into pixel voltage signals; and performing time-division on data lines to supply the converted pixel voltage signals thereto, wherein the step of converting the pixel data into the pixel voltage signals includes:

generating the pixel voltage signals each having a first pixel voltage signal level corresponding to the first time divided pixel data and a second pixel voltage signal level having a voltage at least one step higher in absolute value than the first pixel voltage signal level in correspondence to the first pixel time divided pixel data, wherein the pixel data include even pixel data (RGB even) and odd pixel data (RGB odd).

14. The method according to claim 13, wherein one horizontal period is divided into two half horizontal periods and the pixel data are time-divided to be supplied.

15. The method according to claim 14, wherein the pixel voltage signals are generated using the pixel voltage signal level having a voltage at least one step higher in absolute value than the original pixel voltage signal level in correspondence to the pixel data and output to a pixel of the liquid crystal display device during the first half of the one horizontal period, and is generated in use of the original pixel voltage signal level in correspondence to the pixel data and output to the pixel during the second half of the one horizontal period.

16. The method according to claim 13, wherein one horizontal period is divided into four quarter horizontal periods and the pixel data are time-divided to be supplied.

17. The method according to claim 16, wherein the pixel voltage signals are generated using the pixel voltage signal level having a voltage at least one step higher in absolute value than the original pixel voltage signal level in correspondence to the pixel data and output to a pixel of the liquid crystal display device during the first and third quarters of the one horizontal period, and is generated in use of the original pixel voltage signal level in correspondence to the pixel data and output to the pixel during the second and fourth quarters of the one horizontal period.

* * * * *